United States Patent [19]

Malisch et al.

[11] 3,931,764

[45] Jan. 13, 1976

[54] ACCELERATOR SWITCH

[75] Inventors: Roman Malisch, Neubiberg; Otmar Titus, Taufkirchen; Dietmar Puttinger, Munich, all of Germany

[73] Assignee: Messerschmitt-Bölkow-Blohm GmbH, Germany

[22] Filed: June 21, 1974

[21] Appl. No.: 481,919

[30] Foreign Application Priority Data

June 28, 1973 Germany ..... 2332901

[52] U.S. Cl. ..... 102/70.2 R; 102/73 R

[51] Int. Cl.[2] ..... F42C 11/00; F42C 1/10

[58] Field of Search ..... 102/70.2 R, 73 R

[56] References Cited

UNITED STATES PATENTS

| | | | |
|---|---|---|---|
| 2,949,855 | 8/1960 | Saunderson | 102/70.2 R |
| 2,952,208 | 9/1960 | Wagoner | 102/70.2 R |
| 3,158,705 | 11/1964 | Bliss | 102/70.2 R |
| 3,407,667 | 10/1968 | Doeringsfeld | 102/70.2 R |

*Primary Examiner*—Verlin R. Pendegrass
*Assistant Examiner*—C. T. Jordan
*Attorney, Agent, or Firm*—Toren, McGeady and Stanger

[57] ABSTRACT

In an acceleration switch, such as used for actuating an impact detonator in a projectile, a ball is held between a support surface and a lever member which forms a part of a toggle lever assembly. On impact, the ball causes the lever to pivot and displace another lever member to which it is pivotally connected. When displaced, the toggle lever assembly passes through a dead center position and a portion of its another lever is moved out of the path of a light source and light detector for closing the ignition circuit of the impact detonator. A releasable safety device is provided to prevent premature movement of the lever assembly which would close the ignition circuit.

12 Claims, 7 Drawing Figures

ACCELERATOR SWITCH

BACKGROUND OF THE INVENTION

The invention is directed to an acceleration switch of the type used for actuating an impact detonator by closing its ignition circuit, and, more particularly, it is directed to the arrangement of a lever assembly which is displaceable between a first position and a second position so that in its second position it actuates the ignition circuit.

In U.S. Pat. No. 2,952,208 an impact detonator is disclosed which employs a ball, serving as an inertia body and held on a conical seat to assure release, even when a projectile impacts against a surface at an acute angle. Normally, the ball is held in the rest position by a spring-loaded actuating bar. When an acceleration force causes the ball to move off its seat, the actuating bar is displaced against the force of the spring and a number of spring contacts in an ignition circuit are closed.

In such an arrangement, the ball and the spring-loaded actuating bar form an oscillatory system in which even minor oscillations can amplify the system and lead to an accidental discharge of the ignition condenser or even to an accidental release of the detonator. However, small or relatively brief duration accelerations which occur, for example, when piercing thin-walled targets, when grazing a target, or when striking against a surface at an acute impact angle, are insufficient to close all of the contacts of the ignition system.

SUMMARY OF THE INVENTION

Therefore, it is the primary object of the present invention to provide an acceleration switch which is insensitive to oscillation and which responds even to accelerations of brief duration so that the switching action can take place in a very short period and, at the same time, the switch operates reliably.

Starting with the acceleration switch of the general type described above, the problems experienced in the past are overcome by use of a lever assembly with one of its levers in contact with the ball and with the lever assembly arranged so that it can be displaced between two defined switching positions. Further, another lever in the assembly which is not in contact with the ball forms a barrier or diaphragm in the path of light rays so that displacement of the diaphragm closes an ignition circuit for actuating the impact detonator. Another feature of the invention is the arrangement of the lever assembly as a toggle lever consisting of a pair of two-arm levers, with one lever contacting the ball and the other lever forming the diaphragm acting as a barrier for the path of rays. The lever contacting the ball is a rectilinear member while the other lever has its arms disposed angularly to one another and a spring plate acts against the other lever providing a biasing force against its displacement between its two positions.

As mentioned above, the acceleration switch is operated by displacing the lever assembly from a first position to a second position so that a portion of the lever assembly affording a diaphragm in the path of light rays passing from a source to a detector in the first position is displaced permitting the light rays to impinge on the detector and close an gnition circuit which, in turn, actuates the impact detonator. In passing between its two end positions the toggle lever formed by the lever assembly passes through a dead center position and the lever is held in its end positions by a spring support plate.

Further, the member of the lever assembly which contacts the ball and is formed as a rectilinear member, contains an opening through which a hub is passed for use in assembling the switch. The hub is part of a frame body which supports the ball, the lever assembly and the spring support plate.

In another feature of the invention, the lever assembly is held in the first position by a safety element consisting of a leaf spring displaceable into the path of the lever assembly and a fuse wire holding the leaf spring so that it blocks the movement of the lever assembly from the first into the second position. The fuse wire extends between a pair of contact pins mounted on a base plate of the switch and the fuse wire can be melted by passing current through it by means of the contact pins.

Still another feature of the invention is the use of an external photo-effect and a photo-detector as the source and detector of the light rays used in actuating the ignition circuit.

A particular advantage of the inventive arrangement is that, after the switching movement has been commenced by the ball, the lever assembly effects the immediate release of the switch. This characteristic is provided by the use of a toggle lever arrangement for the lever assembly which passes through its dead center position after a slight rotation from the first position and, due to the an elastic biasing action on the toggle lever moves beyond the dead center into the second position without any additional external force being required. As a result, the ignition circuit is actuated even though the releasing acceleration has discontinued. Another advantageous feature is that, independent of the course of operation, the barrier blocking the paths of the light rays is displaced and an immediate closure of the ignition circuit is achieved. Prior to displacement of the lever assembly into its second position, a simple lock is provided preventing the movement of the diaphragm from the path of the light rays by means of a leaf spring held in the locking position by a fuse wire.

In the locked position of the acceleration switch, though an acceleration force acts on the ball, for example, when a projectile is released, it can have no influence on the lever assembly. No mechanical intervention in the acceleration switch is necessary for releasing the safety device which is effected by melting the fuse wire, which step is carried out when a sharply defined command is given. The switch can be easily installed at any point in the war head of any projectile or missile, even subsequently, as a completely enclosed small part provided with a few connecting contacts and can then be tested.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
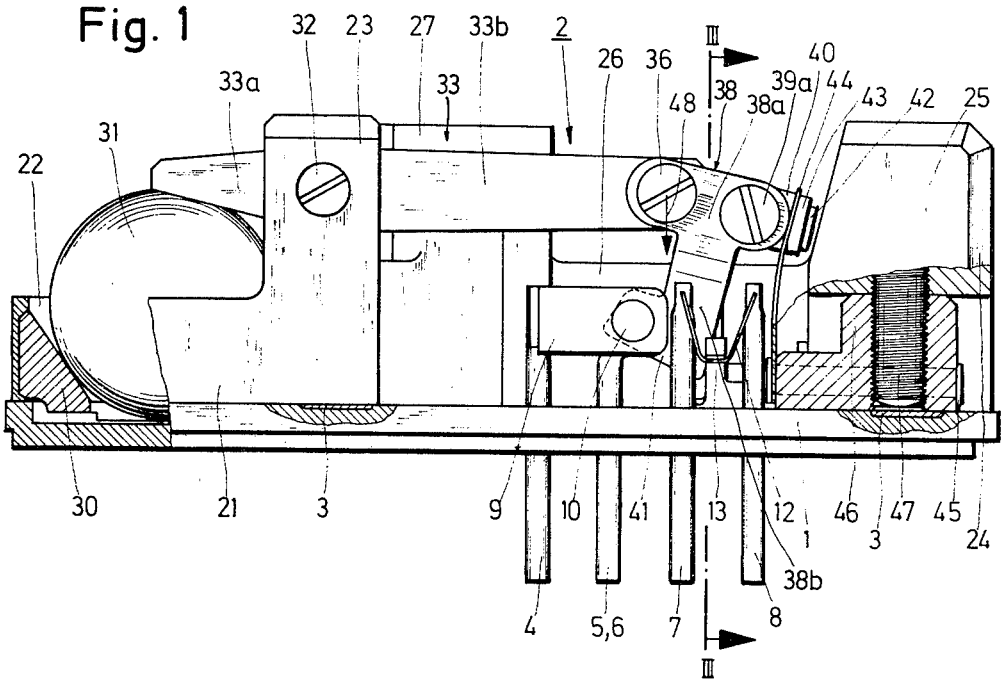
FIG. 1 is a side elevational view, partly in section, of an acceleration switch, embodying the present invention, in its secured or locked position.

The acceleration switch shown in the drawing includes a base plate 1 and a frame body 2 secured together by adhesive foils 3. Electrical contacts for the acceleration switch are mounted on the base plate 1 in the form of five electrical plug pins 4, 5, 6, 7 and 8, connected into the ignition circuit of an impact detonator, not shown, and for providing a source of current.

Figure 3:
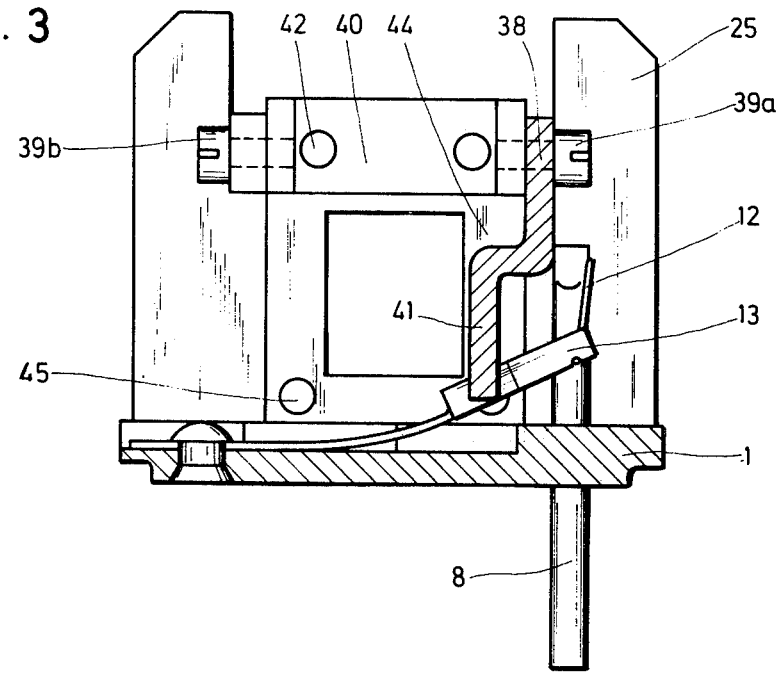
FIG. 3 is a sectional view taken along the lines III—III.
Figure 4:
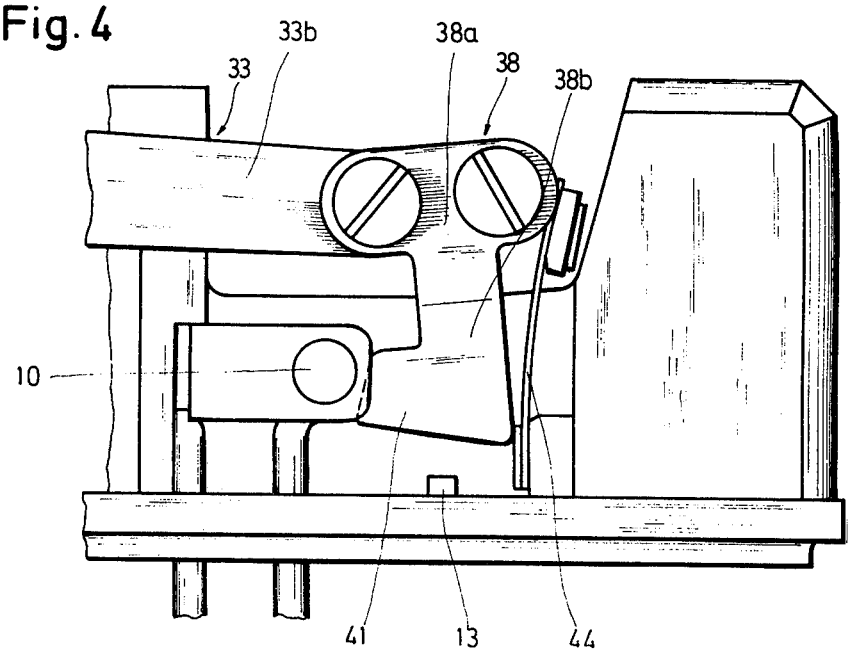
FIG. 4 is a partial side elevational view of the acceleration switch after it has been displaced from its locked position.

Plug pin 4 serves as a ground connection and is fitted into an assembly yoke 9 on which a radiation source 10 and a radiation receiver or detector 11 are mounted. The radiation source and detector form a path of light rays and are connected into the ignition circuit. Plug pins 5, 6 provide a supply of current for the radiation source 10 and the radiation detector 11. Plug pins 7, 8 are connected together over a fuse wire 12. As shown in FIGS. 1 and 3, the fuse wire holds the leaf spring 13 in a lifted position.

Figure 2:
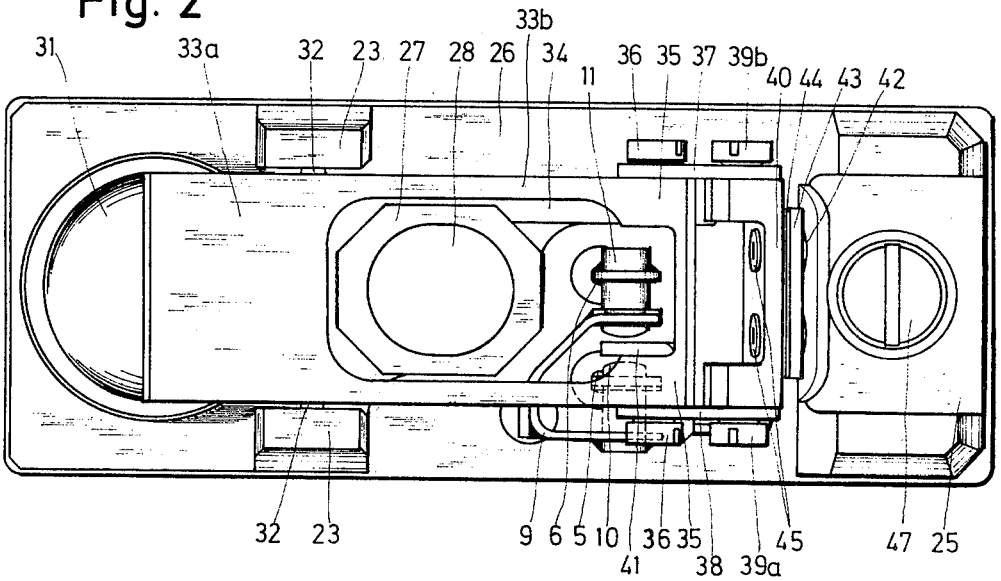
FIG. 2 is a top view of the acceleration switch illustrated in FIG. 1.

The frame body 2 includes a L-shaped bearing part 21 located in the left hand part of the body, as viewed in FIGS. 1 and 2. A bore 22 is formed in the bearing part 21 and holds a supporting part 30 having an inner frusto-conically shaped surface which serves to support a ball 31. To the right of the ball, the bearing part provides a pair of vertically extending side plates 23 into which screws 32 are threaded and serve as bearing axles on the opposite sides of a two-arm lever 33. In FIGS. 1 and 2, the lever is in its secured or locked position with its shorter arm 33*a* extending to the left from the bearing axle into surface contact with the ball 31. The longer arm 33*b* of the lever 33 extends to the right of the bearing axle and it contains an opening 34, note FIG. 2. The right hand end of the level arm 33*b* contains a pair of spaced lugs 35 into which screws 36 are threaded on both sides of the lever 33. On one side, the screws 36 secure a tongue 37 to the lever while on the other side they secure an angle lever 38. The angle lever 38 consists of a first arm 38*a* disposed at a slight angle to the lever 33 and a second arm 38*b* extending downwardly approximately at right angles to the first arm. At the opposite end of the first arm 38*a* from the screw 36, the angle lever 38 is pivotally mounted on a screw 39*a* which is threaded into one side of a U-shaped bearing block 40, note the shape of the bearing block as illustrated in FIG. 2. On the opposite side of the bearing block 40, another screw 39*b* rotatably mounts the opposite end of the tongue 37 from the end attached to the lever 33. Below the fulcrum of the angle lever 38 formed by the screws 36, the second arm 38*b* has an offset portion forming a vertically extending barrier or diaphragm 41 which, in the locked position of the acceleration switch, is located in the path of light rays directed from the radiation source 10 toward the radiation detector 11, note FIG. 2, so that the diaphragm in this position interrupts the path of light rays directed toward the detector. At the right end surface of the bearing block 40, rivets 42 and a reinforcing plate 43 secure a spring support plate 44 to the bearing block.

The spring plate extends downwardly from the bearing block and is secured by rivets 45 to a guide piece 46 supported on the base plate 1. The guide piece 46 is positioned within a groove 24 in a receiving part 25 of the frame body 2 and is secured in place by the screw 47 extending downwardly into the guide piece. The bearing part 21 on the left end of the base plate and the receiving part 25 at its right end are connected together by an intermediate part 26 to which a hub is secured and passes through the opening 34 in the longer or second arm 33b of the lever 33. The hub also has an upwardly extending bore which passes downwardly through the base plate. The hub 27 assists in the assembly of the acceleration switch.

The following is a description of the manner in which the acceleration switch operates.

In combination with the tongue 37 and the angle lever 38, the lever 33 forms a toggle lever assembly with the screws 36 acting as a fulcrum. As mentioned above, the lever assembly, as shown in FIGS. 1, 2 and 3, is in the locked or secured position. Movement of the toggle lever assembly about the fulcrum 36 in the direction of arrow 48, note FIG. 1, is made possible by the pivotal support of the lever 33 on the screws 32 fitted into the side plate 23 and by the elastic articulation of the bearing block, which mounts the angle lever, on the spring support plate 44. In the locked position of the lever assembly, the first arm 33*a* of the lever 33 bears downwardly on the ball 31, and due to the spring support plate, the fulcrum of the toggle lever is pushed upwardly and the diaphragm 41 on the second arm 38*b* of the angle lever is positioned in the path of the light rays passing from the source 10 to the detector 11. This locked position of the lever assembly is provided by the leaf spring 13 held in the blocking position by fuse wire 12, note FIGS. 1 and 3, for preventing displacement of the diaphragm 41 from the paths of the light rays.

To activate the acceleration switch, a flow of current is passed through the two pin plugs 7, 8 for melting the fuse wire 12 and releasing the leaf spring 13 so that it moves downwardly toward base plate 1 and no longer locks the diaphragm 41 in the blocking position. The flow of current for melting the fuse wire can be effected, for example, when a projectile or missile equipped with the acceleration switch is released. When the projectile strikes against a surface, the ball 31, due to the acceleration inertia developed in its path of trajectory, is forced against the first lever arm 33*a* and the toggle lever asssembly undergoes a rotational movement about its fulcrum 36 in the direction of the arrow 48. As mentioned above, in the locked position there is a slight angle between the lever 33 and the first arm 38*a* of the angle lever 38, however, as the lever assembly moves in the direction of the arrow 48, the lever 33 and the first arm 38*a* are arranged in a straight line and the toggle lever assembly passes over a dead center position and the spring support plate 44 biases the bearing block 40 so that the lever assembly continues to move to its second or released position. Accordingly, it is only necessary to lift the ball slightly by an acceleration force to displace the toggle lever assembly through its dead center position and thus afford full movement of the entire lever assembly. In the dead center position of the lever assembly, the path of the light rays between the source 10 and the detector 11 is opened by the lateral movement of the diaphragm 41 so that the detonation of an explosive charge can be commenced without delay.

Figure 5:
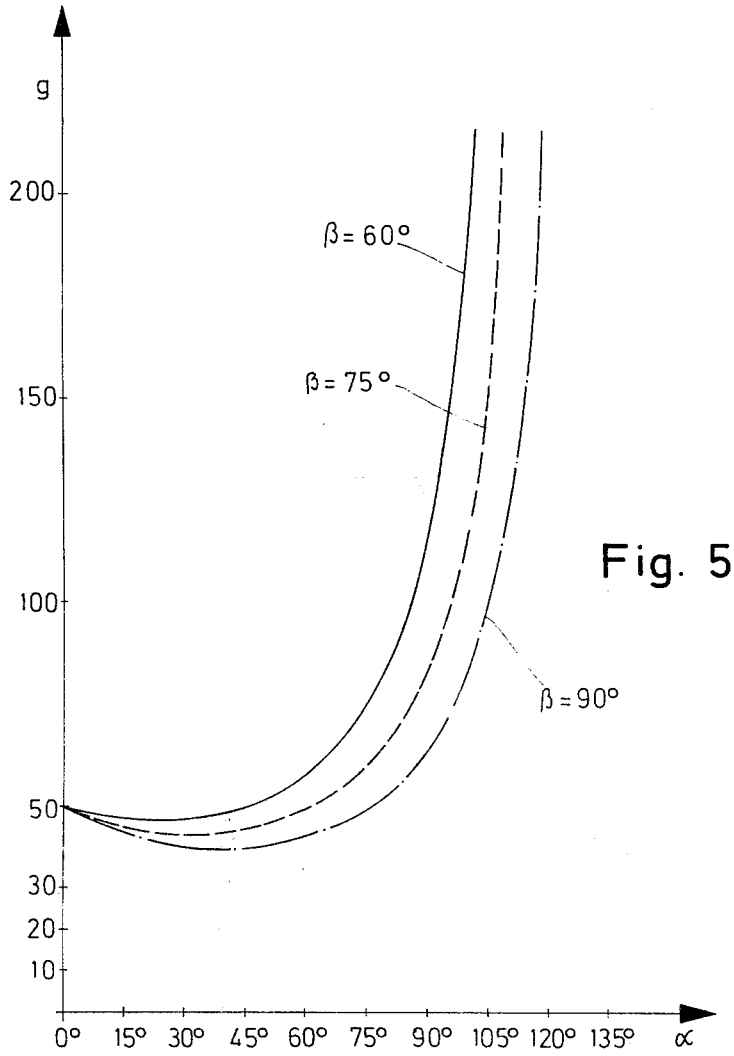
FIG. 5 is a diagram of release accelerations based on target-impact angles for a projectile equipped with the acceleration switch of the present invention.

The release accelerations g plotted in FIG. 5 are at least necessary for activating the acceleration switch with a ball mass of 2.1 g.

Figure 5A:
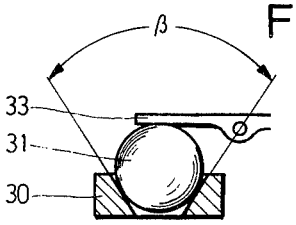
FIG. 5*a* is a simpified illustration of a portion of the acceleration switch illustrating the supporting angles set forth in FIG. 5.
Figure 5B:
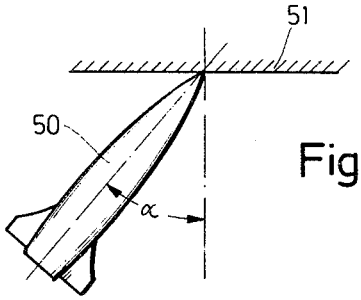
FIG. 5*b* is a schematic view of a projectile striking a target for illustrating the impact angle employed in the diagram of FIG. 5.

In FIG. 5*a* a simplified arrangement of the supporting surface 30, the ball 31 and the lever 33 is illustrated for exhibiting the supporting angle $\beta$ which is defined by the angle formed between the frusto-conically shaped surfaces of the supporting part 30. FIG. 5*b* illustrates the impact angle $\alpha$, that is, the angle of impact of a projectile 50 striking against a target surface 51. In the diagram it is shown that with an impact angle $\alpha$ of 0°, a release acceleration of 50 g is required. It can be seen that the dependence of the release acceleration $g$ on the supporting angle $\beta$ is not great and that a release of the acceleration switch is possible even with impact angles of over 90° up to a maximum of 110°. Due to the small release path of the ball, which in the illustrated example is only 0.25 mm, and due to the small pivotal movement executed by the lever assembly, release times of only about 1.0 msec are required for a release acceleration of 100 g.

It is within the framework of the invention to vary the supporting angle $\beta$ of the supporting part 30 between 0°, that is, guidance of the ball in a cylinder, and approximately 180°, that is, with the ball bearing on a planar plate, depending on the requirements which the acceleration switch must meet. In addition, the bearing surface of the supporting part can also be curved, both convex and concave, instead of being straight, to provide certain release characteristics.

While a specific embodiment of the invention has been shown and described in detail to illustrate the application of the inventive principles, it will be understood that the invention may be embodied otherwise without departing from such principles.

What is claimed is:

1. Acceleration switch, particularly for use in actuating an impact detonator having an ignition circuit, comprising a ball, a member forming a support surface for said ball, a switch actuating member positioned in contact with said ball so that said ball is held between the support surface of said member and said switch actuating member, wherein the improvement comprises a lever assembly displaceable between a first position preventing actuation of the impact detonator and a second position affording actuation of the impact detonator, said lever assembly comprises said switch actuating member and a second member pivotally connected to said switch actuating member at a position spaced from the position on said switch actuating member in contact with said ball, said second member forming a diaphragm at a position spaced from its point of pivotal connection to said switch actuating member, means forming a path of light rays arranged in the ignition circuit for effecting the closure of the ignition circuit, said diaphragm arranged to interrupt the path of the light rays when said lever assembly is in the first position and to be spaced from the path of the light rays when said lever assembly is in the second position so that the ignition circuit can be closed.

2. Acceleration switch, as set forth in claim 1, wherein said switch actuating member comprises a substantially rectilinear first lever member, means for pivotally supporting said first lever member intermediate its end so that it forms a two-arm lever pivotally connected at one end to said second member and in surface contact with said ball at its other end, said second member comprises a second lever member having a first arm pivotally connected to said first lever member and a second arm extending angularly from said first arm, said second arm including said diaphragm which is located at a position spaced from said first arm, means pivotally supporting said first arm of said second lever member at a position spaced from the pivotal connection to said first lever member and a spring support plate in contact with said means pivotally supporting said first arm for providing a biasing action for securing the position of the second lever member relative to said first lever member.

3. Acceleration switch, as set forth in claim 2, wherein said diaphragm extends laterally from said second arm of said second lever.

4. Acceleration switch, as set forth in claim 2, wherein said lever assembly forms a toggle lever with said first lever member and the first arm of said second lever member assuming a straight line alignment in moving between the first and second positions and when said lever member and the first arm of said second lever member are in the straight line alignment said toggle lever is in its dead center position spaced from the first and second positions, and in the first position the first arm of said second lever extends at a slight angle from one side of said first lever member while in the second position said first arm pivots relative to said second lever member so that it extends at a slight angle from the opposite side of said first lever member.

5. Acceleration switch, as set forth in claim 4 including a frame body forming a support for said member forming the support surface for said ball for said switch actuating member and for said spring support plate, said frame body including a hub, said first lever member having an opening therethrough located between its point of pivotal connection on said means and its point of pivotal connection to said second lever member.

6. Acceleration switch, as set forth in claim 4, including a safety element blocking the path of movement of said second lever member from the first position into the second position.

7. Acceleration switch, as set forth in claim 6, wherein said safety element comprises a leaf spring attached to said frame body and displaceable into the path of said second lever member for blocking passage thereof between the first and second positions, a fuse wire supported on said frame body and arranged to hold said leaf spring in position for blocking the movement of the said second lever member between its first and second positions, contact pins mounted on said frame body and said fuse wire connected to said contact pins so that current can be passed through the fuse wire for melting it and releasing said leaf spring.

8. Acceleration switch, as set forth in claim 2, wherein said means for forming a path of light rays includes a source of light rays positioned on one side of said diaphragm when it is in the first position and a source for detecting light rays located on the opposite side of said diaphragm when it is in the first position so that said diaphragm serves as a barrier for preventing light rays emanating from said source from impinging on said detector.

9. Acceleration switch, as set forth in claim 1, wherein said member for supporting said ball is arranged so that its support surface contacting the ball can be disposed in the range from 0° to 180°.

10. Acceleration switch, as set forth in claim 1, wherein said member for supporting said ball has frustoconically shaped diverging upwardly toward said ball.

11. Acceleration switch, as set forth in claim 2, wherein said means pivotally supporting the first arm of said second lever member comprises a U-shaped block, and said spring support plate in contact with said U-shaped block and extending downwardly therefrom, a frame body forming a support for said member forming the support surface for said ball and for said switch actuating member, said spring support plate extending downwardly into contact with said frame body and means securing said spring support plate to said frame body.

12. Acceleration switch, as set forth in claim 11, wherein said lever assembly comprises a tongue extending in laterally spaced relationship to the first arm of said second lever member and being pivotally connected to one end to the second arm of said first lever member and at its opposite end to said U-shaped block.

* * * * *